US005235385A

United States Patent [19]

Rushing

[11] Patent Number: 5,235,385

[45] Date of Patent: Aug. 10, 1993

[54] METHOD AND APPARATUS FOR CONTROLLING TONER IMAGE DENSITY

[75] Inventor: Allen J. Rushing, Webster, N.Y.

[73] Assignee: Eastman Kodak Company, Rochester, N.Y.

[21] Appl. No.: 868,811

[22] Filed: Apr. 15, 1992

[51] Int. Cl.[5] ..... G03G 15/08; G03G 21/00

[52] U.S. Cl. ..... 355/208; 355/246

[58] Field of Search ..... 355/246, 251, 208, 245; 118/657

[56] References Cited

U.S. PATENT DOCUMENTS

| | | | |
|---|---|---|---|
| 4,026,643 | 5/1977 | Bergman | 355/246 |
| 4,155,652 | 5/1979 | Buchan et al. | 356/342 |
| 4,853,738 | 8/1989 | Rushing | 355/246 X |
| 4,891,674 | 1/1990 | Seyfried | 355/251 X |
| 4,965,634 | 10/1990 | Bando | 355/208 |
| 4,975,747 | 12/1990 | Higuchi | 355/246 |
| 4,987,453 | 1/1991 | Laukaitis | 355/246 |
| 4,998,139 | 3/1991 | May et al. | 355/208 |
| 5,005,050 | 4/1991 | Donivan et al. | 355/246 |
| 5,038,175 | 8/1991 | Sohmiya et al. | 355/246 |
| 5,047,802 | 9/1991 | Donivan et al. | 355/208 |
| 5,049,939 | 9/1991 | Koichi | 355/246 |

*Primary Examiner*—Fred L. Braun
*Attorney, Agent, or Firm*—Dennis R. Arndt

[57] ABSTRACT

An apparatus for controlling the transmission density of a layer of pigmented thermoplastic marking particles (e.g., electrographic toner) being deposited on a dielectric film or layer by an electrically biased particle applicator. Such apparatus uses (a) an electrometer for producing a first signal proportional to the level of electrostatic charge on the film after such particles have been applied thereto; (b) a charge-to-mass determining device for producing a second signal proportional to the electrostatic charge-to-mass ratio of the particles applied to the film surface; and (c) a bias voltage controller responsive to the first and second signals for controlling the electrical bias on the particle applicator to control the mass per unit area of the particles applied to the film surface.

4 Claims, 2 Drawing Sheets

METHOD AND APPARATUS FOR CONTROLLING TONER IMAGE DENSITY

BACKGROUND OF THE INVENTION

1. Field of the Invention

The present invention relates to image recording systems of the type in which electrographic toner images are formed on a recording element. More particularly, it relates to a method and apparatus for controlling the transmission density of such images without using transmission densitometry techniques.

2. Discussion of the Prior Art

In the commonly assigned U.S. patent application Ser. No. 673,509, filed on Nov. 30, 1990 in the name of DeBoer et al., there is disclosed an image-recording apparatus in which an intensity-modulated laser beam scans a uniform layer of pigmented thermal plastic particles to cause the irradiated particles to adhere to an underlying thermoplastic substrate in an image configuration. Thereafter, the non-exposed particles are removed from the substrate surface, leaving behind a visible toner image of the information being recorded.

In the above image recording system, the thermoplastic substrate on which image recording is carried out is backed by a grounded electrode, and lay-down of the uniform layer of toner particles is effected by an electrically biased magnetic brush. The level of bias on the brush controls the toner mass lay-down, i.e., "mass per unit area" and, hence, the transmission density of the toner layer For certain applications which make use of the above-mentioned recording process, it is desirable to maintain the maximum transmission density within certain prescribed limits notwithstanding relatively large changes in ambient environmental conditions. When the underlying substrate is transparent to optical radiation, it is a relatively simple matter to monitor, via transmission densitometry techniques, the transmission density of the toner layer or a "test patch" and, by a conventional feedback scheme, to vary the brush bias in order to maintain or achieve a desired transmission density. However, where the underlying substrate is opaque, another approach must be found.

An alternative approach to directly measuring the transmission density of the toner layer is to monitor the reflection density thereof. The reflection density is readily correlated with transmission density at low density levels. But this indirect approach transmission density detection is not useful in those cases where the toner mass lay-down is such that the corresponding reflection density is saturated, or where the toner support does not provide sufficient contrast with the toner material. In some commercial imaging applications, there is a need to provide substantially higher image densities than those detectable by reflection densitometry techniques, and to record such images on relatively non-reflective substrates. Thus, there is a need for a method and apparatus for indirectly determining the transmission density of a relatively dense layer of toner particles on a light-absorbing support.

SUMMARY OF THE INVENTION

In view of the foregoing discussion, an object of this invention is to provide an improved method and apparatus for controlling the transmission density of a layer of toner particles applied to an opaque support by an electrically biased toner-applying device, such as a conventional magnetic brush applicator.

According to the invention, a desired transmission density is achieved by controlling the electrical bias applied to the toner-applying device in accordance with two different signals, one representing the charge-to-mass ratio of the toner particles being applied to the support, and the other representing the level of electrostatic charge on the support after toner has been applied thereto. Preferably, the bias of the toner applicator is initially set on the basis of a desired toner mass per unit area (representing a desired transmission density), an assumed toning efficiency, and a measured charge-to-mass ratio. Thereafter, the bias is "fine-tuned" on the basis of the actual toning efficiency, as represented by the measured level of electrostatic charge on the support after toner has been applied thereto.

The invention will be better understood from the ensuing detailed description of a preferred embodiment, reference being made to the accompanying drawings.

DETAILED DESCRIPTION OF PREFERRED EMBODIMENTS

Figure 1:
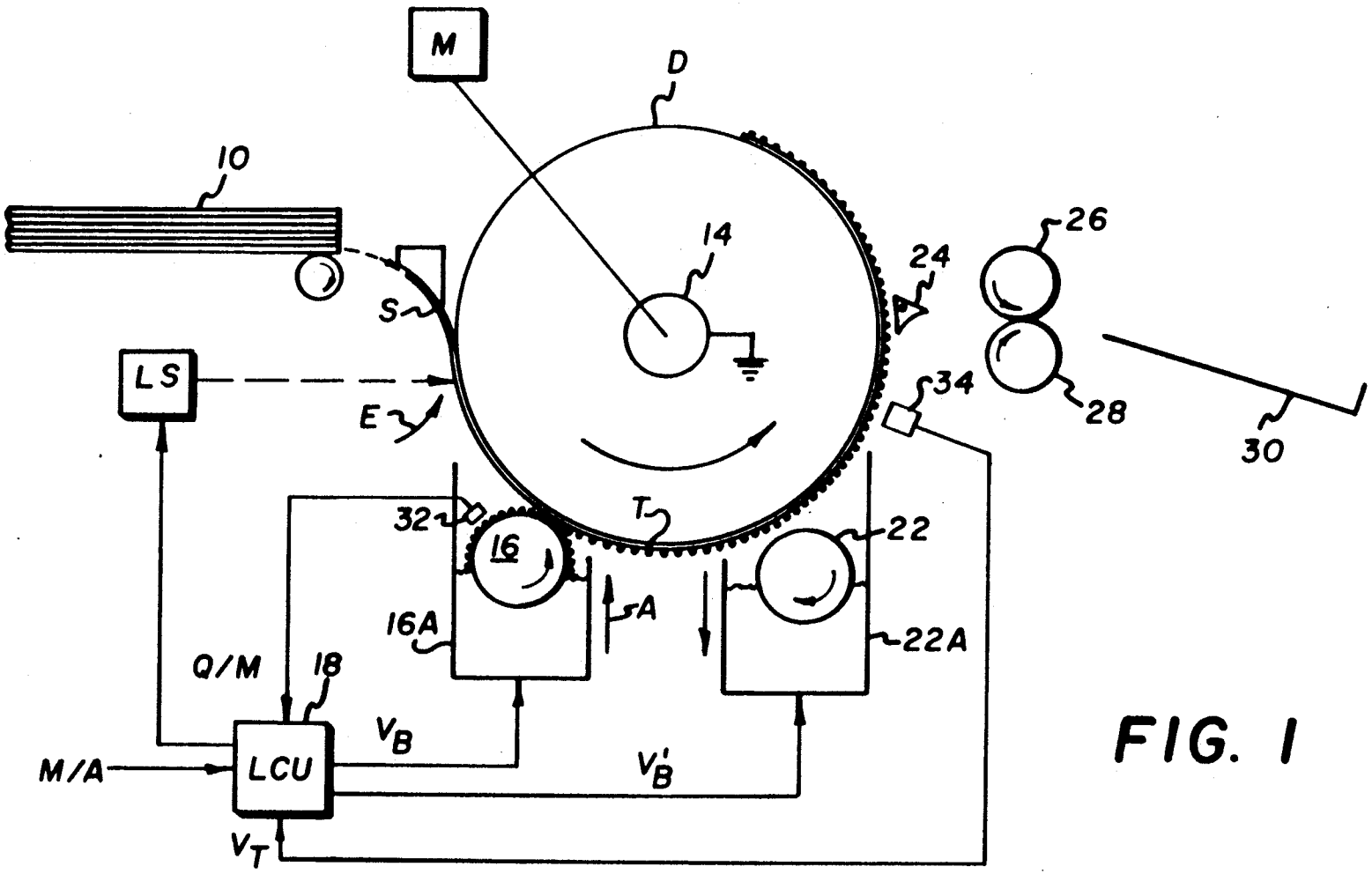
FIGS. 1 and 2 schematically illustrate an image recording system embodying the present invention.

Referring now to the drawings, an image-receiver sheet S is fed from a sheet supply 10 to the surface of an electrically-conductive drum D. Drum D is rotatably driven in the direction of the arrow by a motor M, and the drum drive shaft 14 is electrically grounded, thereby connecting the drum surface to ground potential. Sheet S may comprise, for example, a sheet of Estar film (Trademark of Eastman Kodak Company), plain paper or thermoplastic-coated paper. Alternatively, sheet S may be a multilayer composite structure comprising, for example, a support layer of Estar film having an electrically conductive coating and a thermoplastic layer overlying the conductive layer. The image-receiver sheet is clamped or otherwise attached to the surface of drum D and, as the drum rotates, sheet S is advanced past a conventional magnetic brush 16 of the type commonly employed in electrophotographic copiers and the like to apply pigmented thermoplastic particles to an imagewise charged recording element to render the charge image visible. In this application, however, brush 16 is used to apply a substantially uniform layer of toner particles T to an uncharged surface, namely, the outer surface of the image receiver sheet. Attraction of the toner particles to sheet S results from an electric field between the brush and drum D, such field being created by a bias voltage Vb applied by a conventional microprocessor-based logic and control unit (LCU) 18 to the electrically-conductive brush housing 16A within which the brush rotates. As indicated by the arrow A, the entire brush assembly is vertically movable between an operable position, shown in FIG. 1, in which the brush nap contacts sheet S and applies toner thereto, and a nonoperating position, shown in FIG. 2, in which the brush nap is spaced from the sheet surface.

Upon applying a uniform layer of toner to sheet S, brush 16 is moved away from the drum surface, and the drum velocity is increased from about 20 rpm to several hundred rpm. During this rapid rotation of the drum, the image-receiver sheet S is repeatedly advanced past an exposure station E at which a laser scanner LS operates to imagewise heat selected portions of the toner-bearing sheet, causing the irradiated toner particles to partially melt and become tacky. The laser scanner is of relatively high power (e.g., 1-10 watts), and scanning is effected by slowly moving the laser beam parallel to the drum axis while the drum and sheet advance at a substantially faster linear velocity. During this scanning action, the laser beam intensity is modulated by the LCU in accordance with image information to be recorded.

Figure 2:
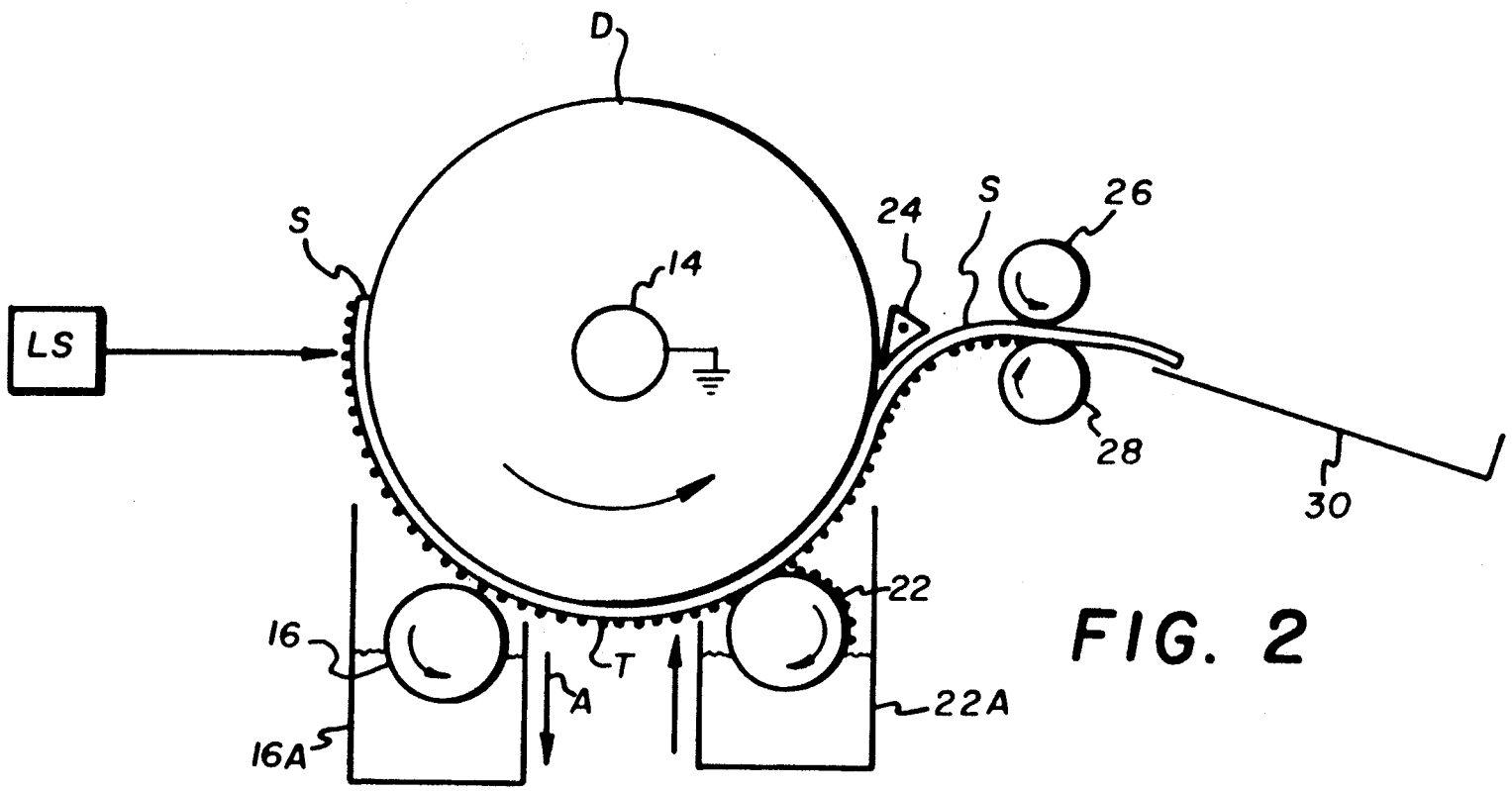

As a result of the above-described process, portions of sheet S bear a tackified toner image while the surrounding or background portions bear loosely held toner particles. Upon completing the laser scanning operation, the drum velocity is reduced to about the same velocity at which toner was applied to sheet S, i.e., about 20 rpm, and a second magnetic brush 22 and sump 22A are moved from a position spaced from the drum, as shown in FIG. 1, to a position in which the brush nap contacts the sheet, as shown in FIG. 2. Unlike brush 16 in which the brush nap is composed of a mixture of oppositely charged toner and magnetic carrier particles, the nap of brush 22 is composed of only magnetic carrier particles, which are electroscopically charged to a polarity to attract toner particles. Like brush 16, however, brush 22 is electrically biased to a suitable bias voltage $V'_B$ provided by the LCU 18. Upon contacting sheet S, the loosely held toner is removed from the sheet, leaving behind the tackified toner image. Sheet S is then stripped from the drum surface by a stripping device 24 and advanced between a pair of heated rollers 26,28 which act to further heat the toner image and thereby fuse it to the sheet. Sheet S is finally deposited in an output tray 30.

In order to control the density of the uniform layer of toner applied to the image-recording sheet by brush 16, there is provided, in accordance with the present invention, an apparatus for indirectly determining the transmission density of this layer. Such apparatus comprises (a) a charge-to-mass (Q/M) measuring device 32 for continuously monitoring the ratio of the toner's electrostatic charge and mass and for producing a first signal representative of this ratio, (b) an electrometer 34 or the like for monitoring the electrostatic charge or voltage ($V_T$) on sheet S after toner has been applied thereto and for producing a second signal representative thereof, and (c) a control device, in this case LCU 18, for controlling the bias voltage $V_B$ on brush 16 based on such first and second signals. Preferably, the Q/M sensor is positioned within sump 16A and comprises a piezoelectric sensor of the type disclosed in the commonly assigned U.S. Pat. No. 5,006,897 to D.S. Rimai et al., the disclosure of which is incorporated herein by reference.

For bias development of a grounded receiver with no charge thereon, certain principles of electrostatics allow the mass laydown of the toner layer (mass per unit area, M/A) to be expressed as a function of (a) the post-toning voltage $V_T$ which represents some fraction, E, of the brush bias potential, (b) the toner charge-to-mass ratio, Q/M, and (c) certain known or readily measurable constants which are characteristic of the receiver sheet and toner. Thus, when such constants are known beforehand, measurements of $V_T$ and Q/M permit the calculation of the toner mass laydown which, as noted, is readily correlated to transmission density. When the mass laydown differs from that corresponding to a desired transmission density, an adjustment of the brush bias voltage is computed by the LCU, and a signal representing the adjusted bias voltage is applied to the brush to achieve the desired transmission density.

In the preferred embodiment, the process bias adjustment is performed in two steps, coarse and fine. For the initial coarse setting of the bias voltage, Q/M is measured in the toning station prior to toning, and the toning efficiency, N, (i.e., the percent by which the applied toner neutralizes the voltage induced on the receiver sheet by the biased brush) is assumed to be some nominal value. The coarse bias voltage corresponding to the desired mass laydown is then computed, by the central processing unit of the LCU, from the following equation:

$$V_B = Q/M\,[(M/A + K)^2 - K^2]/\,2P_vE_tN$$

where $V_B$ is the electrical bias voltage; Q/M is the toner charge-to-mass ratio represented by the output of sensor 32; M/A is a desired toner mass per unit area; $P_v$ is the toner mass density; $E_t$ is the toner dielectric constant; N is an assumed toning efficiency; and $K = P_v d_s(E_t/E_s)$, where $d_s$ is the sheet thickness; and $E_s$ is the dielectric constant of the sheet. The LCU then operates, after brush 16 begins to apply toner to the sheet, to fine tune the brush bias voltage based on the actual toning efficiency $N' = V_T/V_B$, where $V_T$ is a post-toning voltage represented by the output of electrometer 34.

Preferably, in carrying out the above bias adjustment, a series of test image patches is toned, using a range of bias voltages centered about the coarse value computed. The post-toning surface potential ($V_T$) is measured for each patch. The desired mass laydown corresponds to a particular value of $V_T$, and the corresponding $V_B$ is interpolated from the measured $V_T/V_B$ relationship. This is the fine setting of $V_B$ for use in subsequent toning. The ratio $V_T/V_B$ is saved for use as a nominal value of N in the next adjustment cycle.

In the above equation, values are required for the receiver (sheet) thickness (to ground layer) and dielectric constant. Values are also required for effective toner mass density and dielectric constant, taking into account the packing density of the toner particles on the receiver.

Mass laydown (and by inference, transmission density) may be computed regardless of receiver opacity. If the receiver is on a drum, there is no need to remove it as in conventional transmission densitometry. A coarse $V_B$ setting may be determined prior to toning. The test patches may be toned in the middle, or the most representative part, of the image area, then cleaned off prior to image recording the same area. The fine adjustment in the cycle compensates for shifting toning efficiency (percent completion), as produced, for example, by environmental changes (e.g., relative humidity and temperature changes).

The concept and preferred embodiment of the invention are particularly advantageous for image recording systems with bias development of initially uncharged receivers to a high toner mass laydown. The concept may be extended to electrophotographic imaging systems, either CAD or DAD, where the pre-toning Vt is non-zero. In such systems a second electrometer may be needed to measure the pre-toning potential, if it is subject to variability. The difference between the pre-toning and post-toning surface potentials is then used in the electrostatic equations.

The invention has been described with particular reference to preferred embodiments. It will be appreciated, however, that certain modifications and variations can be made without departing from the true spirit of the invention. Such modifications and variations are intended to fall within the scope of the appended claims.

What is claimed is:

1. Apparatus for adjusting the transmission density of a layer of toner particles being applied to a support having an electrically conductive backing by an electrically biased toner-applying device, said apparatus comprising:

(a) charge-to-mass determining means for producing a first signal proportional to the charge-to-mass ratio of the toner to be applied to the support;

(b) an electrometer for producing a second signal proportional to the level of electrostatic charge on the support after toner has been applied thereto; and (c) control means responsive to said first and second signals for controlling the electrical bias on said toner-applying device according to the relationship;

$$V_B = Q/M\ [(M/A+K)^2 - K^2]\ /2P_vE_tN$$

where $V_B$ is the electrical bias voltage; Q/M is the toner charge-to-mass ratio represented by said first signal; M/A is a desired toner mass per unit area; $P_v$ is the toner mass density; $E_t$ is the toner dielectric constant; N is an assumed toning efficiency; and $K = P_v d_s(E_t/E_s)$, where $d_s$ is the support thickness; and $E_s$ is the dielectric constant of the support; and wherein the control means operates, after said toner applicator begins to apply toner to the support, to finally adjust said electrical bias voltage based on the actual toning efficiency $N' = V_t/V_B$, where $V_t$ is a post-toning voltage represented by said second signal; to thereby control the mass per unit area of toner applied to the support.

2. The apparatus as defined by claim 1 wherein said toner-applying device comprises a magnetic brush applicator.

3. The apparatus as defined by claim 1 wherein said charge-to-mass determining means comprises an electrically biased piezoelectric device positioned to attract toner to a surface thereof from said toner-applying device.

4. Method for adjusting the transmission density of a layer of toner particles being applied to a support having an electrically conductive backing by an electrically biased toner-applying device, said method comprising the steps of:

(a) producing a first signal proportional to the charge-to-mass ratio of the toner being applied to the support;

(b) producing a second signal proportional to the level of electrostatic charge on the support after toner has been applied thereto; and (c) controlling, in response to said first and second signals, the electrical bias on said toner-applying device according to the relationship;

$$V_B = Q/M\ [(M/A+K)^2 - K^2]/2P_vE_tN$$

where $V_B$ is the electrical bias voltage; Q/M is the toner charge-to-mass ratio represented by said first signal; M/A is a desired toner mass per unit area; $P_v$ is the toner mass density; $E_t$ is the toner dielectric constant; N is an assumed toning efficiency; and $K = P_v d_s(E_t/E_s)$, where $d_s$ is the support thickness; and $E_s$ is the dielectric constant of the support; and after said toner applicator begins to apply toner to the support, finally adjusting said electrical bias voltage based on the actual toning efficiency $N' = V_t/V_B$, where $V_t$ is a post-toning voltage represented by sad second signal; to thereby control the mass per unit area of toner applied to the support.

* * * * *